US005431365A

United States Patent [19]

Hopkins

[11] Patent Number: 5,431,365

[45] Date of Patent: Jul. 11, 1995

[54] APPARATUS FOR SECURING EQUIPMENT FROM THE EFFECTS OF VIBRATIONS

[75] Inventor: William Hopkins, San Juan Capistrano, Calif.

[73] Assignee: Fastening Solutions, Inc., Van Nuys, Calif.

[21] Appl. No.: 221,176

[22] Filed: Mar. 30, 1994

[51] Int. Cl.[6] ..... A44B 17/00

[52] U.S. Cl. ..... 248/683; 24/170; 24/178; 24/179; 24/180; 248/505

[58] Field of Search ..... 248/683, 551, 505, 500, 248/205.3; 24/179, 180, 170, 304, 188

[56] References Cited

U.S. PATENT DOCUMENTS

| | | | |
|---|---|---|---|
| 187,237 | 2/1879 | Schafer | 24/180 |
| 3,608,158 | 3/1969 | Bengtsson | 24/170 |
| 5,308,253 | 5/1994 | Maki | 248/205.3 |

FOREIGN PATENT DOCUMENTS

| | | | |
|---|---|---|---|
| 424090 | 5/1911 | France | 24/180 |
| 254887 | 1/1949 | Switzerland | 24/180 |

*Primary Examiner*—Leslie A. Braun
*Assistant Examiner*—Gwendolyn Wrenn
*Attorney, Agent, or Firm*—Poms, Smith, Lande & Rose

[57] ABSTRACT

An apparatus for securing equipment to mounting surfaces includes two clamps connected by a strap. One clamp is adhesively mounted to the mounting surface and the second clamp is adhesively mounted to the equipment. Latches pivotally mounted on the top of the clamps include a protrusion, and the strap has holes formed therein. When the latch is pivotally locked onto the strap, the protrusion extends through one of the holes and into a cavity in the base of the clamp. The protrusion also includes a forward corner that is distorted upon pivoting the latch to cause the latch to lock down onto the strap.

12 Claims, 5 Drawing Sheets

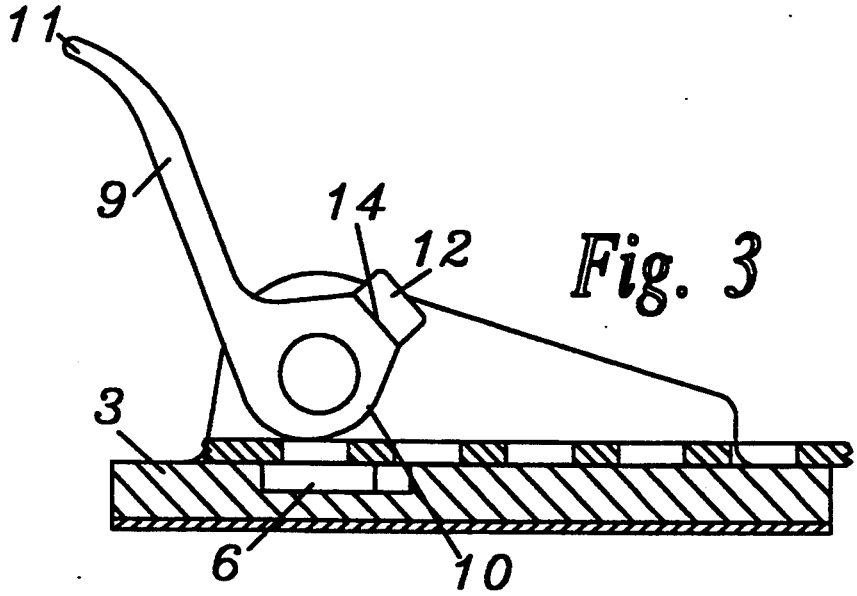
Fig. 3
Fig. 4
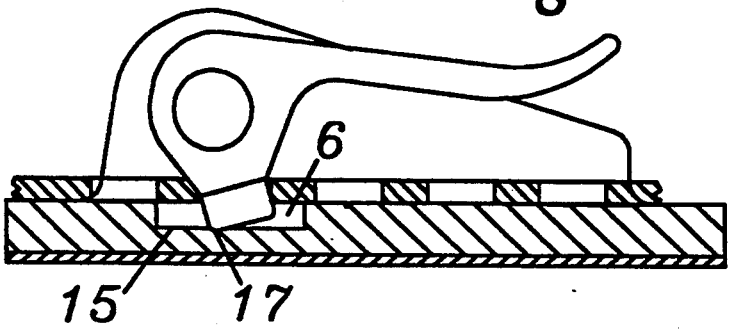
Fig. 5
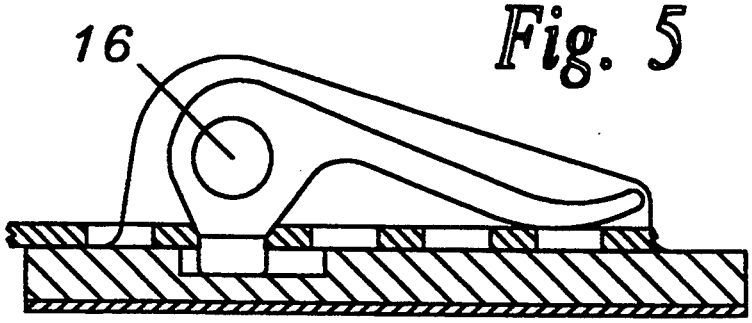

APPARATUS FOR SECURING EQUIPMENT FROM THE EFFECTS OF VIBRATIONS

BACKGROUND OF THE INVENTION

This invention relates generally to apparatus for securing articles, and more particularly to an apparatus for securing equipment to a mounting surface.

The development of expensive high technology equipment, such as computers and computer-related products, has significantly increased productivity. However, protection of such equipment from accidents or natural disasters has not kept pace with technological development. For example, in many parts of the country, an earthquake of moderate magnitude is likely to cause such equipment to fall off the desk to the floor, thereby destroying the equipment.

Such damage can be disastrous to companies and governmental institutions using the computer. Not only are the computers expensive, loss of the data and other information stored on the computer because of the destruction of the computer can be devastating. Bolting the computer to the underlying table does not permit the computer to be conveniently relocated or replaced.

Clamp assemblies for straps are known in the art, and are typically used to secure one end of a belt or other strap-like object to the other end. For example, U.S. Pat. No. 3,608,158 to Bengtsson depicts a buckle having a latch that bears down onto a strap. U.S. Pat. No. 632,793 to Sell et. al. depicts another buckle that has a latch that bears down onto a strap. U.S. Pat. Nos. 2,916,786 to Legat; 3,413,692 to Elsner; 3,177,545 to Svensson; 3,678,542 to Prete; 3,855,669 to Meyer; 4,987,654 to Mejias; and 3,872,554 to Wolfertz all depict a clamping assembly that has a latch that clips onto and holds a strap. There are also patents that disclose buckling devices, such as U.S. Pat. Nos. 631,669 to Rankin; 939,902 to Garrison; 1,072,498 to Redmond; 1,096,787 to Kraetzer; 4,233,713 to Berg; and 4,631,784 to Fildan. However, these patents depict devices that are intended to hold one end of a strap to the other end of the same or another strap, generally in a linear direction.

Such devices are suited for securing cargo and similar objects to a dolly or cart, but are not suitable for securing equipment such as electrical components to a mounting surface. Such devices would have to be strapped entirely around the mounting surface, which is often impractical or infeasible. Moreover, such an arrangement would have an unpleasant appearance in an office environment.

Devices have been developed for holding computers to tables. Some apparatus use hook and loop fasteners and adhesive to mount the computer to the computer desk. U.S. Pat. No. 5,050,836 to Makous discloses a security device for holding a computer on a table having a cord extending between mounts on the computer and table, but such an arrangement would not assist in keeping the computer on the table in an earthquake because the cord is loosely connected. U.S. Pat. Nos. 4,170,995 to Levine; 5,031,956 to Hudgins; 4,360,300 to Nadherny; 4,953,714 to Paul; and 4,407,477 to Backlund all disclose tie-down or fastening devices for securing equipment or other items. However, none of those patents disclose a means for securing computers in the event of an earthquake or other disturbance.

Recently, the "THUMBLOCK TM" fastener developed by Fastening Solutions of Los Angeles, Calif. has been a very successful product for holding a computer to a table. The THUMBLOCK TM fastener includes a clamp mounted to the computer, a clamp mounted to the desk, and a strap between the two clamps.

Although that fastener has many advantages and has proved quite successful, there are certain limitations to the device. For instance, the engineering of the device must be extremely accurate, or the strap may slip. As a result, though most of the fasteners fail if the adhesive mounting the latch to the table or to the computer fails, some products that are not engineered to close tolerances could slip. The necessary engineering may become expensive and result in costly quality control problems.

Thus, a better apparatus that guards against slip is needed for securing equipment to a mounting surface, such as a desk, so that in the event of an earthquake or other jarring disturbance the equipment remains safely on the table or other surface. Such an apparatus should be easy to install, use, and remove. The apparatus should also be attractive and inexpensive to manufacture. The present invention fulfills these needs and provides further related advantages.

SUMMARY OF THE INVENTION

The present invention provides an apparatus for securing an object, such as a computer, to a surface, such as a desk or table. The present invention is relatively inexpensive to manufacture, is quickly installed or removed, and is easy to use. According to the present invention, a clamping assembly comprises at least two clamps and a tension strap. One of the clamps is mounted to the computer and one is mounted to the table or other mounting surface. One end of the strap is attached to one of the clamps and the other end is attached to the second clamp.

To attach the strap to the clamp, a latch on the top of each clamp is pivoted to engage the strap. The latch includes a protrusion at the strap-engaging end. A cavity formed in the upper surface of the base accommodates the protrusion. The strap has holes therethrough so that when the latch is clamped down onto the strap, the protrusion extends through one of the holes and into the cavity to secure the strap.

As the latch is pivoted onto the strap, the bottom wall of the cavity contacts a corner of the protrusion. To close the latch, the corner is pushed past the bottom wall of the cavity to lock the latch in a closed position. As a result, the closed latch has the protrusion extending through a hole in the strap.

The protrusion extending through the strap keeps the strap from slipping. By affixing one clamp to the computer and another clamp to the table, the clamps and strap restrict the movement of the computer and thereby protect the equipment from falling off of a desk, shelf, or other mounting surface in the event of an earthquake or other jarring disturbance. If the computer is to be moved, each latch is lifted so that the strap can be drawn out of the clamps.

BRIEF DESCRIPTION OF THE DRAWINGS

Other features and advantages of the present invention will be apparent from the following Detailed Description taken in conjunction with the accompanying Drawings, in which:

FIG. 3 is a cross-sectional view of the clamp and strap of FIG. 1 in an open position;

FIG. 4 is a cross-sectional view of the clamp and strap of FIG. 1 in a partially closed position;

FIG. 5 is a cross-sectional view of the clamp and strap of FIG. 1 in a closed and locked position;

DETAILED DESCRIPTION

Figure 1:
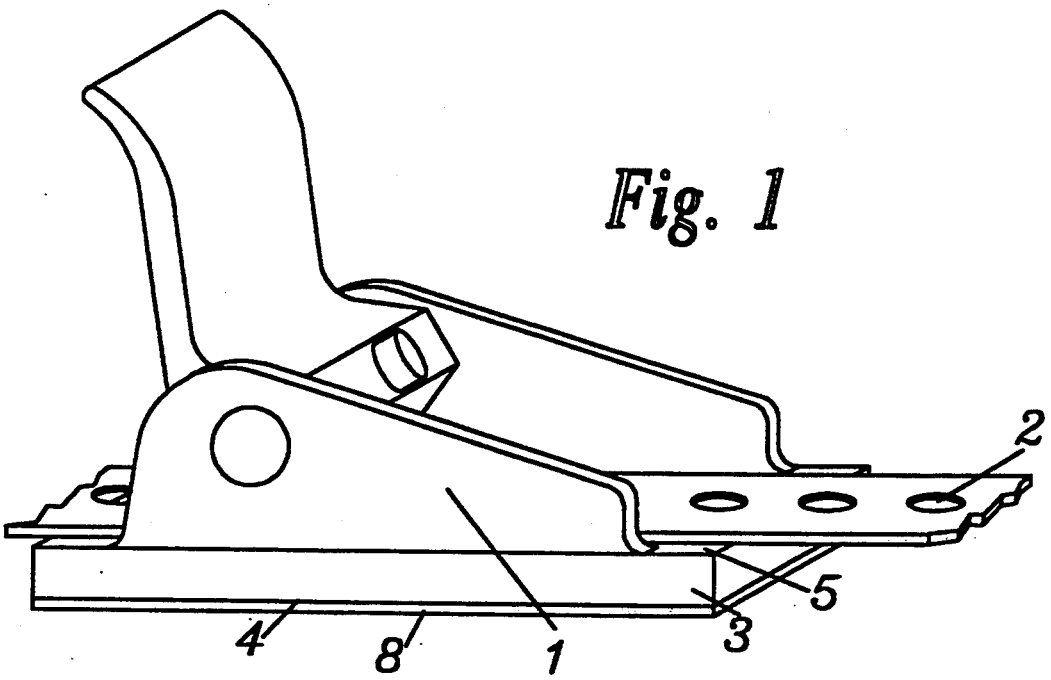
FIG. 1 is a perspective view showing the clamp and strap of the present invention in an open position.
Figure 2:
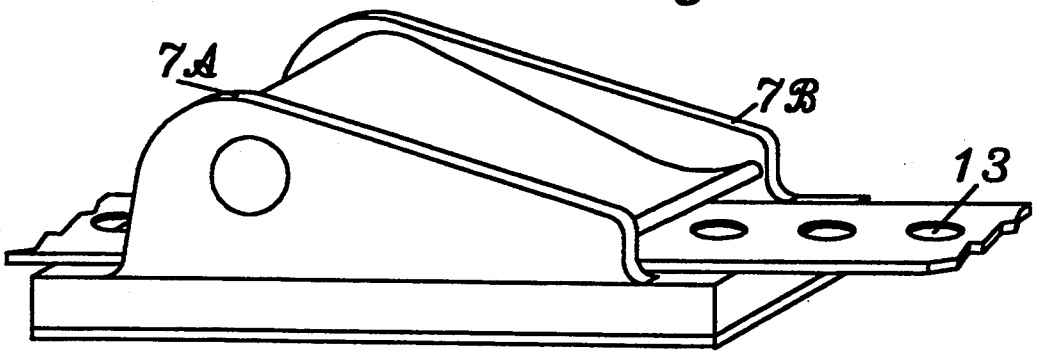
FIG. 2 is a perspective view showing the clamp and strap of FIG. 1 in a closed position.

As shown in the drawings, the present invention is embodied in a clamp 1 and a strap 2 that secure equipment to a table or desk. The clamp 1 comprises a base 3 having a smooth bottom surface 4 and an upper surface 5 into which a cavity 6 and two flanges 7A and 7B are formed. An adhesive bonding means such as a double-sided adhesive strip 8 is secured to the bottom surface 4 of the base 3.

A latch 9 is pivotally mounted between the two flanges 7A and 7B. The latch 9 has a first, strap-engaging end 10 and a second, lever end 11. A protrusion 12 is formed on the first end 10 of the latch 9.

The strap 2 has a series of holes 13 drilled therethrough at predetermined positions for receiving the protrusion 12. The strap 2 has sufficient length to interconnect a clamp I mounted to the table and another clamp mounted to the computer equipment. The strap also has a sufficient thickness and strength to hold the computer to the table in the event of an earthquake or other jarring disturbance.

Figure 8:
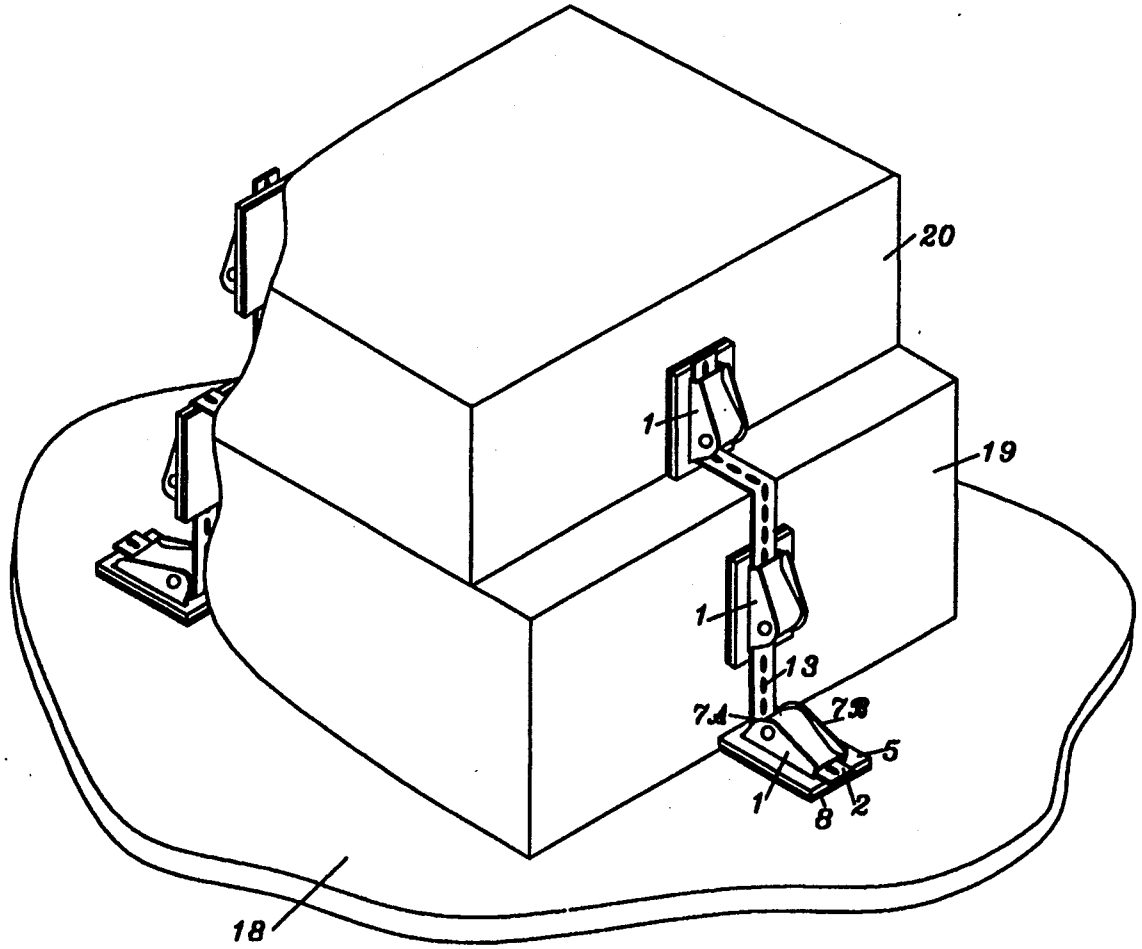
FIG. 8 is a perspective view showing the clamp of FIG. 1 installed on a computer.

As depicted in FIG. 8, in operation one clamp 1 is adhesively mounted to the table surface 18. Preferably, the base 3 of the clamp 1 on the table contacts the object to resist lateral motion of the computer. Another clamp 1 is secured to the computer equipment 19.

One end of the strap 2 is inserted into the opening formed by the upper surface 5 of the base 3, the two flanges 7A and 7B, and the latch 9 of one of the clamps 1. The latch is then pivoted down onto the strap, as depicted in FIGS. 3 and 4. The protrusion 12 on the first end 10 of the latch 9 is long enough that as the latch is pivoted onto the strap 2, the protrusion 12 extends through one of the holes in the strap and into the cavity 6 formed on the upper surface of the base 3. The protrusion thereby holds the strap in position. A friction surface 14 on the first end 10 of the latch 9 may also be included to push the strap into the cavity 6 and assist in resisting movement of the strap.

As depicted in FIG. 8, the other end of the strap 2 is inserted into a second clamp 1. The two clamps are turned toward each other so that when a strap 2 is connected between the two clamps, movement of the computer 19 creates tension in the strap 2 so that the clamps 1 act against each other to hold the computer on the table surface 18. This process is repeated until a sufficient number of clamp and strap assemblies have been attached to secure all objects, such as the auxiliary equipment 20, to the table surface.

Figure 6:
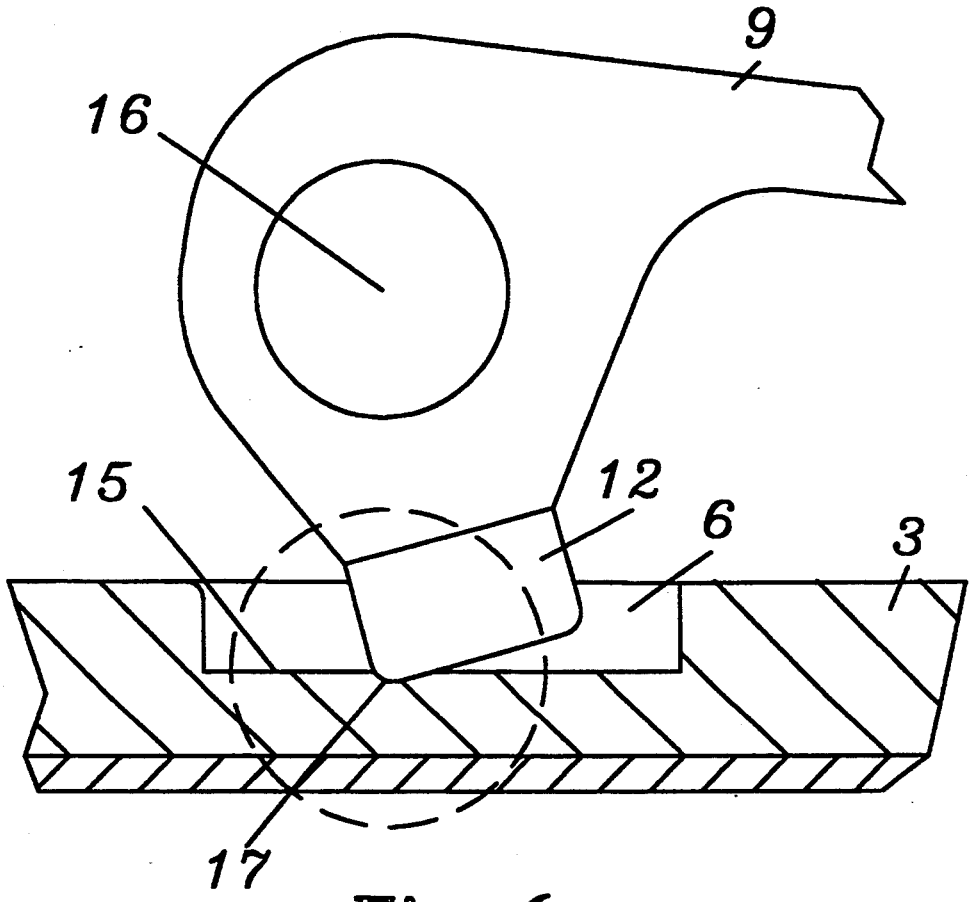
FIG. 6 is a partial cross-sectional view of the clamp of FIG. 1 in a partially closed position.
Figure 7:
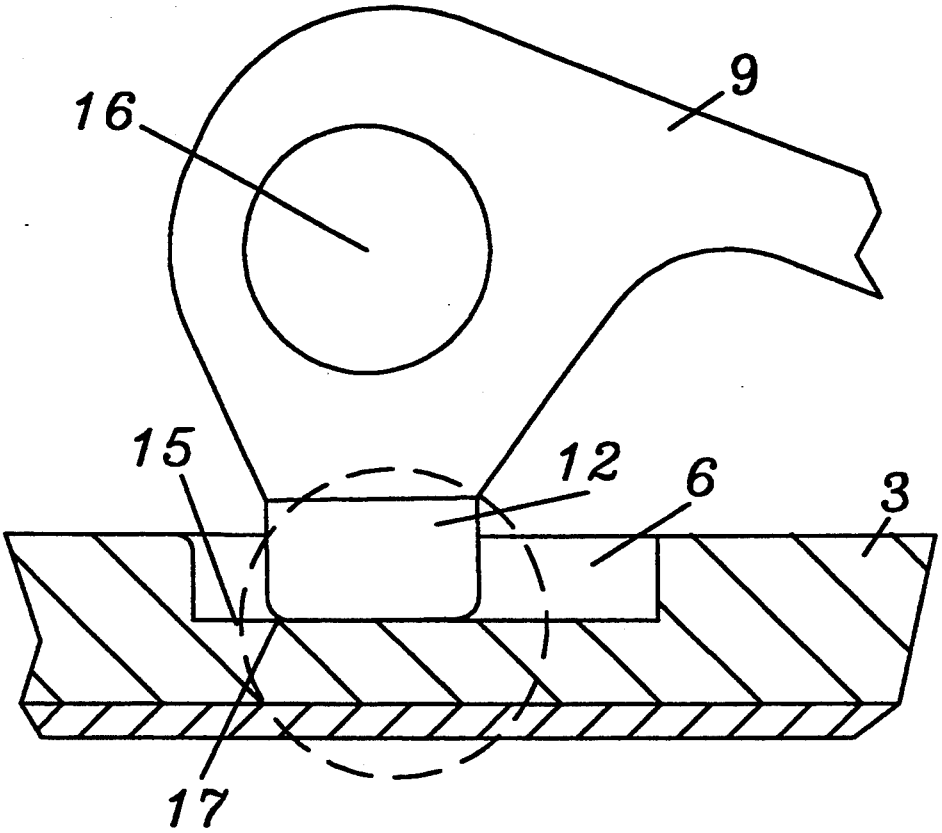
FIG. 7 is a partial cross-sectional view of the clamp of FIG. 1 in a closed and locked position.

As depicted in FIGS. 6 and 7, the protrusion 12 has a forward corner 17 that is of a size and dimension that when the latch 9 is pivoted, the forward corner 17 of the protrusion strikes the bottom 15 of the cavity 6 formed in the base 3. This contact creates additional resistance to closure of the latch. As the forward corner of the protrusion is pushed past the bottom of the cavity, some portion of the clamp I elastically contorts. Preferably, the latch is pushed slightly upward at the pivot point 16 in the flanges 7A and 7B. Once the forward corner 17 is pushed past the bottom 15 of the cavity 6, the corner increases the locking resistance to hold the latch in the closed position, thereby maintaining the grip of the clamp 1 on the strap 2.

Generally, the clamp works in connection with one or more other clamps, all of which are locked onto the strap. However, there may be circumstances in which the strap could be permanently mounted to the desk or the computer, and only one clamp would therefore be required.

In the event of an influence that would generally cause the computer to move, such as an earthquake or an object bumping into the mounting surface or the computer, the clamps and straps mounted to the equipment prevent it from moving. The strength of the clamp and strap assemblies can exceed several hundred pounds, which is likely to be significantly greater than the force generated by the movement of the equipment.

The strap 2 is constructed from a strong plastic material that can be manufactured inexpensively, such as by extrusion. Although other types of straps could be used, a plastic coated fiber core strap such as the three quarter SFX GY101 E-A/A sold by Bioplastics Company Incorporated of North Ridgeville, Ohio, is preferred. The holes in the strap are preferably formed by a secondary punching operation as is known in the art.

The clamps are typically made of a strong, inexpensive and resilient material such as injection molded plastic. The clamps must have at least a limited amount of elasticity so that the forward corner 17 of the protrusion may elastically engage the bottom 15 of the cavity 6 and deflect a portion of the clamping assembly, such as the corner of the protrusion, the bottom of the cavity, or, in the preferred embodiment, the latch 9 at the pivoting points 16 that pivotally mount the latch 9 to the flanges 7A and 7B. Furthermore, increasing the area of the base 3 and using a larger surface area for the adhesive strip 8 will increase the effective strength of the clamp 1.

The adhesive strip 8 used to attach the base to the mounting surface may be any strong glue or other such adhesive, but is preferably the foam-type double-sided adhesive strips, such as the VHB4950 sold by 3M. Prior to attaching the adhesive strip 8, the surface is cleaned with a quick-drying alcohol solution, so that the adhesive makes good contact with the mounting surface. If the computer or other equipment is to be relocated, the adhered base may be pried off of the mounting surface, and the adhesive may then be peeled off of the base by hand. After cleaning the base 3, a new adhesive strip may be attached to the base. The clamping assembly may thereby be reused in a different location.

For some equipment, the adhesive strip 8 may not be used, but rather the equipment could be formed with the clamping assembly as a portion thereof, thereby eliminating the need for an adhesive to connect the clamping assembly to the equipment. Likewise, the mounting surface could also be formed with a clamping assembly therein, and thereby eliminate the need for an adhesive thereon. Because the adhesive strip 8 tends to be the weakest part of the clamping assembly, elimination of the adhesive strip in such a fashion would significantly increase the strength of the assembly. The strength of the connection is based on the adhesive used, and so if the adhesive is not used because the clamps have been formed into the computer and the mounting surface, the strength of the surface becomes the shear strength of the protrusion coupled with the friction surface, or the tensile strength of the strap.

Although one embodiment of the invention has been illustrated and described, various modifications and changes may be made by those skilled in the art without departing from the spirit and scope of the invention.

I claim:

1. An apparatus for use in securing equipment and furniture in general and computer equipment in particular, to a table or surface comprising:

a strap having a predetermined length and having a series of holes therethrough;

a first clamp and a second clamp, each clamp having a rectangular base with an upper surface and a smooth lower surface having a bottom wall, the upper surface forming a rectangular cavity positioned at a predetermined position near a first longitudinal end of the base and having two parallel flanges extending perpendicularly from the upper surface of the base proximate to, and on opposite sides of, the cavity;

means for adhesively securing the lower surface of the base of the first clamp to the table;

means for adhesively securing the lower surface of the base of the second clamp to the computer equipment;

a latch pivotally mounted between the two flanges and above the cavity of each clamp, each latch having a first, locking end that includes a protrusion to engage with one of the holes formed by the strap and a second, lever end for pivoting the latch; and means for causing each protrusion to lock into position in the cavity formed in the upper surface of the base of the respective clamp when the strap is inserted into the clamp and the latch is pivoted to engage the protrusion with the strap and being locked into position by the clamping cooperation of an end of said protrusion with said bottom wall of the said cavity and thereby resist lateral motion of the strap.

2. The apparatus of claim 1 wherein the means for adhesively connecting the lower surface of the base of each clamp is a layer of double-sided bonding material on the lower surface of the base.

3. The apparatus of claim 1 wherein each clamp is made of plastic.

4. The apparatus of claim 1 wherein the strap has a plastic coated fiber core.

5. A clamp for use in combination with a strap to secure computer equipment to a table comprising:

a rectangular base with an upper surface and a smooth lower surface, the upper surface forming a rectangular cavity having a bottom wall positioned at a predetermined position near a first longitudinal end of the base and having two parallel flanges extending perpendicularly from the upper surface of the base proximate to, and on opposite sides of, the cavity;

means for adhesively connecting the lower surface of the base to a surface of the table;

a latch pivotally mounted between the two flanges and above the cavity, the latch having a first, locking end for engaging the strap and a second, lever end for pivoting the latch;

a protrusion on the first end of the latch adapted to engage with a hole formed in the strap to hold the strap in position when the latch is pivoted to a closed position; and means for causing the protrusion to lock into position in the cavity formed in the upper surface of the base when pivoted to engage the strap and thereby resist lateral motion of the strap and being locked into position by the clamping cooperation of an end of said protrusion with said bottom wall of the said cavity.

6. An apparatus for use in securing computer equipment to a table comprising:

a strap;

a clamp having an upper surface and a lower surface, the upper surface forming a cavity positioned at a predetermined position near a first longitudinal end of the base and said cavity having an end wall; and a latch pivotally mounted to a base proximate to, and on opposite sides of, the cavity, the latch having a first, locking end that includes a means for engaging with a hole formed in the strap and a second, lever end for pivoting the latch wherein said engaging means has a protrusion adapted to be locked into position by the clamping cooperation of said protrusion with said bottom wall of said cavity.

7. The apparatus of claim 6 further comprising a means for causing the protrusion to lock into position in the cavity formed in the upper surface of the base when the latch is pivoted to engage the strap.

8. The apparatus of claim 6 further comprising a means for adhesively connecting the lower surface of the clamp to a surface.

9. The apparatus of claim 6 further comprising a means for pivotally mounting the latch to the upper surface.

10. The apparatus of claim 9 wherein the means for pivotally mounting the latch comprises two parallel flanges extending perpendicularly from the upper surface proximate to, and on opposite sides of, the cavity.

11. The apparatus of claim 6 wherein the means for engaging the latch to the strap comprises a protrusion on the locking end of the latch.

12. The apparatus of claim 6 further comprising a means for causing the locking end of the latch to lock into position in the cavity formed in the upper surface when the latch is pivoted to engage the strap inserted into the clamp and thereby resist lateral motion of the strap.

* * * * *